US009472067B1

(12) United States Patent
Jentoft

(10) Patent No.: US 9,472,067 B1
(45) Date of Patent: Oct. 18, 2016

(54) SECURITY DEVICES AND RELATED FEATURES

(71) Applicant: RSI Video Technologies, Inc., Vadnais Heights, MN (US)

(72) Inventor: Keith Jentoft, Circle Pines, MN (US)

(73) Assignee: RSI Video Technologies, Inc., Vadnais Heights, MN (US)

( * ) Notice: Subject to any disclaimer, the term of this patent is extended or adjusted under 35 U.S.C. 154(b) by 104 days.

(21) Appl. No.: 14/338,874

(22) Filed: Jul. 23, 2014

Related U.S. Application Data

(60) Provisional application No. 61/857,586, filed on Jul. 23, 2013.

(51) Int. Cl.
*G08B 13/00* (2006.01)

(52) U.S. Cl.
CPC ..... *G08B 13/00* (2013.01)

(58) Field of Classification Search
CPC ..... G08B 13/00
USPC ..... 340/541
See application file for complete search history.

(56) References Cited

U.S. PATENT DOCUMENTS

| | | | |
|---|---|---|---|
| 3,634,846 | A | 1/1972 | Fogiel |
| 4,266,216 | A | 5/1981 | Trusty |
| 4,347,590 | A | 8/1982 | Heger et al. |
| 4,540,977 | A | 9/1985 | Taillens et al. |
| 4,772,875 | A | 9/1988 | Maddox et al. |
| D302,951 | S | 8/1989 | Kotlicki et al. |
| 4,857,912 | A | 8/1989 | Everett, Jr. et al. |
| 4,864,136 | A | 9/1989 | Behlke |
| 4,882,567 | A | 11/1989 | Johnson |
| D307,560 | S | 5/1990 | Andrews et al. |
| D312,054 | S | 11/1990 | Melman |
| 5,026,990 | A | 6/1991 | Marman et al. |

(Continued)

FOREIGN PATENT DOCUMENTS

| | | | |
|---|---|---|---|
| DE | 4423947 | A1 | 1/1996 |
| DE | 10150745 | A1 | 4/2003 |
| EP | 676733 | A | 10/1995 |
| EP | 811959 | A | 12/1997 |
| EP | 0856826 | A2 | 8/1998 |
| EP | 0986038 | | 3/2000 |
| EP | 1115264 | A2 | 7/2001 |
| EP | 1363260 | A1 | 11/2003 |
| EP | 1499098 | A1 | 1/2005 |
| EP | 1575009 | | 9/2005 |
| EP | 1316933 | B1 | 8/2006 |
| GB | 2325548 | A | 11/1998 |
| GB | 2358504 | A | 7/2001 |
| GB | 2395336 | A | 5/2004 |
| JP | 01236397 | A | 9/1989 |

(Continued)

OTHER PUBLICATIONS

Indoor MotionViewer DCV601, Datasheet [online]. RSI Video Technologies, 2220-IMVIS Mar. 2012 (Feb. 22, 2013). http//www.videofied.com.au/pdf/2013/installation.

(Continued)

*Primary Examiner* — Hai Phan
*Assistant Examiner* — Zhen Y Wu
(74) *Attorney, Agent, or Firm* — Crawford Maunu PLLC

(57) ABSTRACT

Aspects of the present disclosure are directed to security-based apparatuses and methods. As may be implemented in accordance with one or more embodiments, an apparatus includes a presence sensor that senses the presence of an individual, and an image sensor that captures an image of the individual in response to the sensed presence, and that provides the captured image as image data. A user authorization circuit identifies the individual as being authorized or unauthorized based upon the provided image data and stored image data for authorized individuals. An electromechanical device operates with the user authorization circuit to deploy one or more deterrents in the vicinity of the individual, in response to the user authorization circuit identifying the individual as being unauthorized.

19 Claims, 2 Drawing Sheets

(56) References Cited

U.S. PATENT DOCUMENTS 5,077,548 A 12/1991 Dipoala
5,155,474 A 10/1992 Park et al.
5,202,661 A 4/1993 Everett et al.
5,237,330 A 8/1993 Yaacov et al.
5,299,971 A 4/1994 Hart
5,382,944 A 1/1995 Dipoala et al.
5,398,057 A 3/1995 Tapp
5,402,000 A * 3/1995 Owens, II ..... 340/545.1
5,424,718 A 6/1995 Muller et al.
5,448,290 A 9/1995 VanZeeland
5,448,320 A 9/1995 Sakai et al.
5,450,062 A 9/1995 DiPoala
5,473,368 A 12/1995 Hart
5,515,029 A 5/1996 Zhevelev et al.
D381,283 S 7/1997 Soreo
5,657,076 A 8/1997 Tapp
5,661,471 A 8/1997 Kotlicki
5,693,943 A 12/1997 Tchernihovski et al.
5,703,368 A 12/1997 Tomooka et al.
5,790,040 A 8/1998 Kreier et al.
D399,155 S 10/1998 Roberts
5,819,124 A 10/1998 Somner et al.
5,832,671 A 11/1998 White
5,850,180 A 12/1998 Hess
D409,936 S 5/1999 Baldwin et al.
5,936,524 A 8/1999 Zhevelev et al.
5,980,123 A 11/1999 Heifler
6,037,902 A 3/2000 Pinhas et al.
6,049,273 A 4/2000 Hess
6,188,715 B1 2/2001 Partyka
6,211,522 B1 4/2001 Kotlicki et al.
6,271,752 B1 8/2001 Vaios
6,285,912 B1 9/2001 Ellison et al.
6,292,508 B1 9/2001 Hong et al.
6,411,209 B1 6/2002 Lyons et al.
6,476,858 B1 11/2002 Ramirez Diaz et al.
6,504,479 B1 1/2003 Lemons et al.
6,636,738 B1 10/2003 Hayashi
D485,774 S 1/2004 Hwang et al.
6,686,952 B1 2/2004 Brazier
6,690,414 B2 2/2004 Lyons et al.
6,700,487 B2 3/2004 Lyons et al.
6,759,957 B2 7/2004 Murakami et al.
6,768,294 B1 7/2004 Moldavsky et al.
6,768,868 B1 7/2004 Schnell
6,818,881 B1 11/2004 Chernichovski et al.
6,819,239 B2 11/2004 Bingham
6,940,405 B2 9/2005 Script et al.
6,965,313 B1 11/2005 Saylor et al.
6,970,183 B1 11/2005 Monroe
D516,445 S 3/2006 DiPasquale
7,079,028 B2 7/2006 Herrmann et al.
7,081,817 B2 7/2006 Zhevelev et al.
D527,296 S 8/2006 Concari et al.
7,106,193 B2 9/2006 Kovach
7,149,422 B2 12/2006 Schnell
7,151,945 B2 12/2006 Myles et al.
7,463,145 B2 12/2008 Jentoft
7,463,146 B2 12/2008 Reibel et al.
7,471,334 B1 12/2008 Stenger
7,619,512 B2 11/2009 Trundle et al.
7,835,343 B1 11/2010 Reibel
8,081,073 B2 12/2011 Reibel et al.
8,155,105 B2 4/2012 Reibel et al.
8,248,226 B2 8/2012 Friar
8,259,816 B2 9/2012 Coleman, Sr.
8,378,988 B1 * 2/2013 Artino ..... H04N 7/186 235/382
8,520,068 B2 8/2013 Naidoo et al.
2001/0028798 A1 10/2001 Manowitz et al.
2002/0067259 A1 * 6/2002 Fufidio ..... G07C 9/00031 340/541
2002/0159770 A1 10/2002 Moultrie
2002/0171557 A1 11/2002 Wegener
2003/0065407 A1 4/2003 Johnson et al.
2003/0128130 A1 7/2003 Kao
2003/0193563 A1 10/2003 Suzuki
2003/0202117 A1 10/2003 Garner
2004/0086088 A1 5/2004 Naidoo et al.
2004/0109059 A1 6/2004 Kawakita
2004/0113778 A1 6/2004 Script et al.
2004/0155781 A1 8/2004 DeOme
2004/0190467 A1 9/2004 Liu et al.
2004/0205823 A1 10/2004 Tsai
2004/0205824 A1 10/2004 Tsai
2004/0239497 A1 12/2004 Schwartzman et al.
2005/0024206 A1 2/2005 Samarasekera et al.
2005/0030180 A1 2/2005 Pantus et al.
2005/0073580 A1 4/2005 Takeda et al.
2005/0134450 A1 6/2005 Kovach
2005/0134454 A1 6/2005 Eskildsen
2005/0200494 A1 9/2005 Herrmann et al.
2005/0275549 A1 12/2005 Barclay et al.
2006/0204050 A1 * 9/2006 Takizawa ..... 382/115
2006/0250501 A1 11/2006 Widmann et al.
2007/0018106 A1 1/2007 Zhevelev et al.
2007/0036535 A1 2/2007 Chee
2008/0079561 A1 4/2008 Trundle et al.
2008/0174100 A1 * 7/2008 Reeves ..... G06Q 50/18 283/70
2008/0252412 A1 * 10/2008 Larsson ..... B60R 25/25 340/5.2
2008/0259161 A1 10/2008 Hellman et al.
2008/0311878 A1 12/2008 Martin et al.
2010/0080548 A1 4/2010 Peterson et al.
2010/0092764 A1 4/2010 Chung et al.
2010/0289644 A1 11/2010 Slavin et al.
2011/0183643 A1 7/2011 Martin et al.
2012/0001755 A1 * 1/2012 Conrady ..... H04N 7/186 340/540
2012/0086767 A1 4/2012 Lau et al.
2012/0092163 A1 * 4/2012 Hart ..... G08B 19/005 340/541
2012/0314901 A1 12/2012 Hanson et al.
2013/0148950 A1 6/2013 Chang
2014/0267716 A1 * 9/2014 Child et al. ..... 348/143
2014/0267740 A1 * 9/2014 Almomani ..... G07C 9/00182 348/156
2015/0156031 A1 * 6/2015 Fadell ..... H04L 12/2816 700/276

FOREIGN PATENT DOCUMENTS

JP 11154292 A 6/1999
JP 2003233889 A 8/2003
JP 2005071064 A 3/2005
WO WO8800747 1/1988
WO WO9725696 7/1997
WO 0003367 A1 1/2000
WO WO0127763 4/2001
WO 0246919 A2 6/2002
WO 2004064355 A2 7/2004
WO 2004079684 A1 9/2004
WO 2004114648 A2 12/2004
WO WO2005034060 4/2005
WO 2005065196 A2 7/2005

OTHER PUBLICATIONS

"Indoor Motion Viewer DCV601" Datasheet [online]. RSI Video Technologies, Feb. 22, 2013, http://www.videofied.com.au/pdf/2013/Installation%20sheets%202013/DCV701%20Indoor%20Motionviewer%20install%20sheet.pdf pp. 1-4.

European Search Report, European Patent Application No. 15158810.0, 2 pp. (Jul. 17, 2015).

* cited by examiner

SECURITY DEVICES AND RELATED FEATURES

FIELD

Aspects of various embodiments are directed to security devices and methods.

BACKGROUND

A variety of applications benefit from protection of residents, employees, property and other items using security systems, such as to monitor and/or sense certain conditions such as a facility-operations problem or the presence of an unwanted intruder. Many such security systems are connected to a central control unit and monitored by an operator who can alert the appropriate emergency services in the event of an unwanted intruder. Other systems are self-contained, and operate without necessarily interacting with an outside system or operator.

While security systems can be helpful, challenges remain with regard to response time between detecting adverse situations and providing a remedy. Some security systems require interaction with a user in order to operate properly with regard to alerting to certain conditions, which can be costly and time-consuming. In addition, many systems generate false alarms, which can result in fees that are assessed by local authorities. Moreover, many systems are challenging to implement with occupied premises, with regard to discerning unwanted intruders.

These and other matters have presented challenges to implementing security for a variety of applications.

SUMMARY

Various example embodiments are directed to security methods and apparatuses, and their implementation.

According to an example embodiment, an apparatus includes a presence sensor, an image sensor, a user authorization circuit and an electromechanical device. The presence sensor senses the presence of an individual, and the image sensor captures an image of the individual in response to the presence sensor sensing the individual's presence. The captured image is provided as image data, and a user authorization circuit identifies the individual as being authorized or unauthorized based upon the provided image data, as well as stored image data for authorized individuals (e.g., via a comparison or facial recognition approach). The electromechanical device operates with the user authorization circuit to deploy one or more deterrents in the vicinity of the individual, in response to the user authorization circuit identifying the individual as being unauthorized.

Another embodiment is directed to a method as follows. The presence of an individual is sensed, and an image of the individual is captured in response to the sensed presence. The captured image is provided as image data and received in a user authorization circuit that identifies the individual as being authorized or unauthorized based upon the provided image data and stored image data for authorized individuals. At least one deterrent is automatically deployed via an electromechanical device in the vicinity of the individual, in response to the user authorization circuit identifying the individual as being unauthorized.

The above discussion/summary is not intended to describe each embodiment or every implementation of the present disclosure. The figures and detailed description that follow also exemplify various embodiments.

DESCRIPTION OF THE FIGURES

Various example embodiments may be more completely understood in consideration of the following detailed description in connection with the accompanying drawings, in which.

Figure 1:
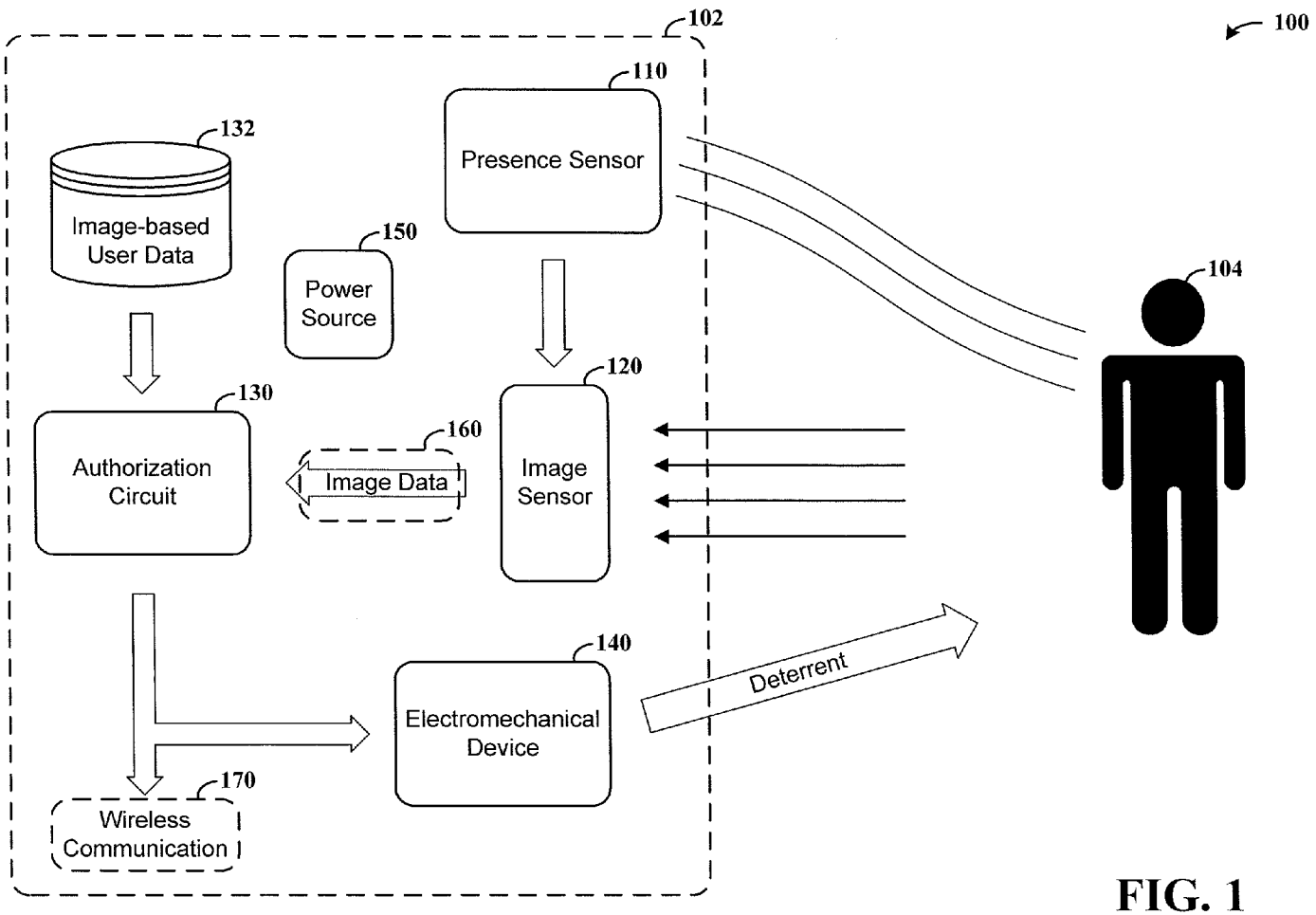
FIG. 1 shows an apparatus for providing security, in accordance with an example embodiment.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DESCRIPTION

The present invention is believed to be applicable to a variety of different approaches and arrangements for providing security services. The invention has been found to be particularly advantageous for addressing security monitoring needs in a residence or private office environment.

Various aspects of the present disclosure are directed toward security enhancement devices. The security enhancement devices, for example, can be provided as stand-alone devices and/or integrated into security monitoring devices (e.g., integrated motion detector and alarm). For instance, a security enhancement device, consistent with various aspects of the present disclosure, deters or halts intruders by recognizing an unwarranted or unwanted presence, and deploys a deterrent at or towards the unwarranted or unwanted presence. The security enhancement device, in certain embodiments, includes one or more deterrent aspects that deter or halt entrance into a secured area. Such tangible deterrents which would be capable of being felt, can include pepper sprays, skin irritants, eye irritants, offending odorant solutions, dye sprays, electroshock devices (e.g., stun guns), and/or temporal incapacitating devices (e.g., tranquilizer guns). Further, the deterrents can also include placebo deterrents (e.g., scented steam) that would mimic one or more of the above deterrents. Additionally, in certain embodiments, a security enhancement device that includes such tangible deterrents can deploy the deterrents at or towards the unwarranted or unwanted presence. Various aspects of the present disclosure are provided to prevent activation of a security enhancement device by wild/domestic animals (e.g., facial recognition, Infrared sensing). For instance, facial recognition can determine if an intruder is human, and Infrared sensing can verify the shape of the intruder as being human or non-human.

Security enhancement devices, consistent with various aspects of the present disclosure, are deployed in response to an unwarranted or unwanted presence. In certain embodiments, the deterrents are deployed in response to detection of an unwarranted or unwanted presence by a camera (video or still). In other embodiments, the deterrents are deployed in response to detection of an unwarranted or unwanted presence by an Infrared detection sensor (e.g., Passive Infrared (PIR) sensor). These deployment mechanisms can also be used in conjunction to provide an added level of security such that a presence is verified to be unwarranted or unwanted by a camera and an Infrared detection sensor.

Tangible deterrents such as pepper sprays, skin irritants, eye irritants, electro-shock and tranquilization are provided to stop further intrusion into a monitored space. Further, these type of deterrents and placebos such as odorants, and steam allow for deterring an intruder as well as indication to other further intruders that an area is being monitored. Moreover, a deterrent such as dye can assist in identification of an intruder due to the dye marking the intruder.

Additionally, in certain embodiments, security enhancement devices, consistent with various aspects of the present disclosure, are provided with an Infrared detection sensor. In this manner, such deterrents can be deployed by a security enhancement device in response to heat and/or movement sensed via Infrared detection.

In certain embodiments of a security enhancement device that includes a camera for use in detecting an unwarranted or unwanted presence, the presence is detected by use of facial recognition software. A database of facial profiles of authorized persons can be kept in memory of a stand-alone security enhancement device. Additionally, data of facial profiles of authorized persons can be kept in memory at a security monitoring device that includes a security enhancement device. Moreover, such data can be stored at a control panel that communicates with a stand-alone security enhancement device and/or with a security monitoring device that includes a security enhancement device. Further, data of facial profiles of authorized persons can be kept in memory at a control monitoring center that communicates with a stand-alone security enhancement device and/or with a security monitoring device that includes a security enhancement device. The database of facial profiles, in certain embodiments, can be provided at one or more of the stand-alone security enhancement device, security monitoring device, the control panel, and/or the control monitoring center. Wireless communication can occur using a transceiver for wirelessly communicating with central devices, monitoring devices, third-party monitoring stations, and/or an end user.

In the embodiments including facial recognition capabilities, a camera can compare the detected presence to the database of facial profiles of authorized persons to determine if the detected presence is unwarranted or unwanted. If the detected presence is determined as being unwarranted or unwanted, the device can deploy the deterrents. Additionally, embodiments of the present disclosure allow for a user to utilize a live view of the area monitored by the security enhancement device (or devices if multiple security enhancement devices are provided). In this manner, the user can decide whether or not to deploy the deterrents. A user can be alerted to the detected presence of any intrusion and/or the detected presence of an unwarranted or unwanted person. Further, a user can view the area monitored by the security enhancement device without engaging any alert, and can determine whether or not to deploy any deterrents.

Various aspects of the present disclosure allow for a user to remotely access the monitoring device and/or security enhancement device. The monitoring device and/or security enhancement device will receive a remote video access request. The request can originate, for example, from an application on a mobile phone or from a computer. The monitoring device and/or security enhancement device will then operate to authenticate the user. If the monitoring device and/or security enhancement device determines that authorization is invalid, access will be denied. If the alarm is not activated, access will be denied by the monitoring device and/or security enhancement device. If the alarm is activated, the monitoring device and/or security enhancement device will allow access. At this point, the user can view current video or images captures by the monitoring device and/or security enhancement device, the user can arm or disarm the monitoring device and/or security enhancement device, and/or the user can adjust the angles of the PIR sensor, the Infrared light emitting diodes, and/or the camera of the monitoring device and/or security enhancement device.

In some embodiments, a deterrent is coupled with the monitoring device and operable in response to remote user control. An actuator or other deployment mechanism is responsive to remote user inputs by dispensing the deterrent, in a predefined direction and/or in a direction controlled by the user. In more particular embodiments, a user is alerted in response to automated intruder detection, and is provided with an opportunity to remotely view the intruder (e.g., to assess identification) and control the dispensing of the deterrent. For example, such an approach may be implemented in which a central control center is coupled to a multitude of monitored environments. When an intruder is automatically detected (e.g., via face recognition), an alert can be provided along with live video to the central control center, where a user can assess the video and remotely deploy a deterrent. The deterrent can be deployed via the sensing device detecting the intruder, or via other devices located in a common environment and strategically placed for countering unwanted intrusion.

Moreover, the various aspects of the present disclosure are directed toward facial recognition as utilized to track intruders who enter and exit a property that is monitored by the security enhancement device. For instance, if a person entering a location monitored by the security enhancement device is determined to be authorized (proper credentials via, for example a proper password entered into a keypad or a key fob), the security enhancement device can utilize facial recognition to indicate that the person is authorized for future entrance even in the absence of the proper credentials. Additionally, the security enhancement device can recognize that a person not having the proper credentials is unauthorized for all future entrances to a monitored location. This authorization aspect for future entrance can also be modified by the user.

Various aspects of the present disclosure are also directed toward security enhancement devices that include various types of activation and deactivation. For example, the security enhancement device can include a clock function such that the device is active outside of business hours (e.g., 9:00 a.m. and 5:00 p.m.). Furthermore, the security enhancement devices can be activated by a user (e.g., via a key fob or passcode) to change from activated to deactivated states. Moreover, the security enhancement devices, in certain embodiments, include various levels of security activation. For instance, a lower level of security setting can allow for the device to deploy a selected type (as automatically selected by the CPU) of deterrent(s) in response to a detected intrusion (e.g., verified by facial recognition or Infrared sensing). In addition, a higher level of security setting can deploy deterrents in response to a detected and verified intrusion. Yet an even higher level of security setting can deploy deterrents in response to any verified or unverified intrusion.

In certain embodiments, security enhancement devices, consistent with various aspects of the present disclosure, utilize a camera or PIR to calculate the deployment distance of deterrents. For instance, a security enhancement device calculates the distance between an intrusion and the camera, based on normal spray radius and distance of a deterrent.

Various circuit-based building blocks and/or other modules may be implemented to carry out one or more of the operations and activities described herein, and/or shown in the block-diagram-type figures. In such contexts, these building blocks and/or modules represent circuits that carry out one or more of these, or other related operations/activities. For example, in certain of the embodiments discussed above, one or more blocks and/or modules are discrete logic circuits or programmable logic circuits configured and arranged for implementing these wireless communication protocols, as in the circuit modules/blocks described above. In certain embodiments, the programmable circuit is one or more computer circuits programmed to execute a set (or sets) of instructions (and/or configuration data). The instructions (and/or configuration data) can be in the form of firmware or software stored in, and accessible from, a memory (circuit).

Yet other embodiments are directed to combinations of the above aspects in which such above-discussed features and operations are operated together for application-specific functions and environments. For instance, in a camera-enabled security system that uses facial (or other bio-indicating) recognition and in response to the system detecting that an unauthorized person has been detected (e.g., within so many feet of the target area), rather than activating a spray on the unauthorized person, the system is capable of alerting the end user. In this aspect, the end user would have manual control over such activation feature(s) and/or can concurrently issue a ramp-up warning of a potential spray for audible/visual reception by the unauthorized person. It should be appreciated that other such combinations of the above aspects would also be useful for other such application-specific functions and environments.

Security systems, consistent with various aspects of the present disclosure, can include receivers and transmitters to communicate between security enhancement device(s) and a monitoring station. In some instances, a monitoring device may be implemented with only a transmitter. In other instances, a monitoring device may be implemented with only a receiver. Other implementations allow for one or more of the central devices (e.g., control panel(s)) and monitoring devices (e.g., peripheral device(s)) to have both a transmitter and receiver (transceiver). Thus, a transceiver is used herein to describe a receiver, transmitter or both a receiver and transmitter.

Communication between a central control panel device and security enhancement devices can occur via wireless communications. The wireless communications may be implemented using suitable frequencies. For instance, wireless communications frequencies in industrial, scientific and medical (ISM) radio bands (900 MHz, 433 MHz, 2.4 GHz and 5.8 GHz) have been found to be suitable for monitoring systems; however, alternate frequencies may be implemented in accordance with the particulars of the system or its intended implementation. Additionally, wireless communications between the central control panel device and monitoring/peripheral devices can occur via WiFi, Bluetooth®, 3G and/or 4G wireless (or another comparable protocol).

As discussed above, a control panel can communicate to the various devices using a variety of wireless data communication protocols. Specific wireless communication systems and devices are discussed in further detail in U.S. Pat. No. 8,155,105 (see, e.g., FIG. 1A therein) entitled "Spread Spectrum Wireless Communication and Monitoring Arrangement and Method." U.S. Pat. No. 8,155,105 is fully incorporated herein by reference for such related teachings. More particularly, this U.S. patent document is incorporated by reference with regards to exemplary circuits for implementing wireless communication between a central device and a remote monitoring device.

Security monitoring arrangements, as described above, are discussed in further detail in U.S. Pat. No. 7,463,145 (see, e.g., FIG. 1A therein) entitled "Security Monitoring Arrangement and Method Using A Common Field Of View;" and U.S. Pat. No. 7,463,146 (see, e.g., FIG. 1A therein) entitled "Integrated Motion-Image Method And Device." U.S. Pat. Nos. 7,463,145 and 7,463,146 are fully incorporated herein by reference for such related teachings. More particularly, this U.S. patent document is incorporated by reference with regards to exemplary circuits for implementing security monitoring device(s).

In accordance with another embodiment, an apparatus includes a presence sensor such as a motion-based sensor, and an image sensor that operates to collect an image of a premises or region. The apparatus also includes a user authorization circuit (e.g., a processor-type circuit) and an electromechanical device. The presence sensor senses the presence of an individual, such as by detecting Infrared or heat characteristics, and the image sensor captures an image of the individual in response to the presence sensor sensing the individual's presence. The captured image is provided as image data, such as by converting light to an electric signal at a photosensor. The user authorization circuit identifies the individual as being authorized or unauthorized based upon the provided image data as well as stored image data for authorized individuals, such as by comparing the data in a facial recognition approach. The electromechanical device operates/deploys one or more deterrents in the vicinity of the individual in response to the individual being identified as unauthorized (e.g., an intruder). Such a deterrent may, for example, include an undesirable or debilitating gas or liquid, sound or other materials that may act to dissuade an individual from approaching further.

In a more particular embodiment, the image data is transmitted over a network when the individual is identified as being unauthorized. This approach may, for example, save cost and power by transmitting the image data only when the individual is identified as unauthorized. Further, this approach can be used to mitigate false alarms, and also permit operation of the apparatus while authorized individuals are present. In other embodiments, the image data is transmitted in all cases, with an authorization being carried out remotely.

In certain embodiments, the apparatus (e.g., as part of a system) includes a remote interface that uses the transmitted image data to display an image of the individual identified as being unauthorized for verification by a user. A deterrent deployment instruction is transmitted over the network in response to a user input received from the user (e.g., if the user identifies the individual as being unauthorized). The electromechanical device is responsive to the transmitted deployment instruction by deploying the deterrent in the vicinity of the individual.

In more particular implementations, the presence sensor senses or determines a distance between the individual and the presence sensor, as the individual is moving relative to the presence sensor. The sensed distance can be used in a number of manners, to suit particular embodiments. In some embodiments, the distance is used to trigger the image sensor for image capture, thus timing the image capture with the sensed presence and, for certain implementations, saving power by permitting the image sensor to be off or in a low-power state until an individual comes within a certain distance threshold (e.g., moves past a first warning area).

In other embodiments, the image sensor captures the image of the individual in response to the distance between the individual and the presence sensor decreasing to a threshold distance level. In certain implementations, a warning circuit presents a warning to the individual in response to the sensed distance decreasing to a first threshold, and the image sensor captures the image in response to the sensed distance decreasing to a second threshold that is a shorter distance than the first threshold.

In certain distance-sensing embodiments, the apparatus includes an audio circuit that operates with the presence sensor to generate an audible sound warning in the vicinity of individuals identified as being unauthorized, and the sensed distance decreasing to a first threshold. The user authorization circuit transmits the image data in response to the sensed distance decreasing to a second threshold that is a shorter distance than the first threshold. In other implementations, the electromechanical device deploys one or more deterrents in the vicinity of the individual in response to the user authorization circuit identifying the individual as being unauthorized and the sensed distance decreasing to a second threshold that is a shorter distance than the first threshold. As characterized above and herein, the audible sound warning may include a sound informing the individual that a toxic substance will be deployed if the user moves further toward the presence sensor (e.g., where the deterrent does not include the toxic substance), and may be accompanied by flashing light emitted by a light-emitting circuit that operates to flash light at a rate that increases in response to the distance between the individual and the presence sensor decreasing.

In some embodiments, the user authorization circuit operates with the image sensor to process the image data based on facial recognition criteria, using stored facial recognition criteria indicative of authorized individuals. The individual is therein identified as being authorized or unauthorized via facial recognition. Certain embodiments are directed to a similar approach in which the individual is identified as being unauthorized when the image data does not match the stored image data.

In accordance with one or more embodiments, the presence of an individual is sensed and an image of the individual is captured in response to the sensed presence. The captured image is provided as image data and received in a user authorization circuit that identifies the individual as being authorized or unauthorized based upon the provided image data and stored image data for authorized individuals. When the user authorization circuit identifies the individual as being unauthorized, a deterrent such as a spray is automatically deployed via an electromechanical device in the vicinity of the individual.

In some implementations, the image data is transmitted over a network in response to identifying the individual as being unauthorized, and the transmitted data is used to display an image of the individual identified as being unauthorized for verification by a user. The user can then evaluate the data and transmit a deterrent deployment instruction over the network, with the deterrent being automatically deployed (e.g., without further human intervention) in response to the deterrent deployment instruction.

In some embodiments, the distance between the individual and a presence sensor that senses the individual's presence is sensed. In some implementations, before the image data is transmitted an audible sound warning is provided in the vicinity of the individual in response to the user authorization circuit identifying the individual as being unauthorized, and the sensed distance decreasing to a first threshold. If the sensed distance decreases to a second threshold that is a shorter distance than the first threshold (i.e., the individual moves further toward the sensor), the image data is transmitted for authorization by the user. In this regard, a warning is first provided and, if the individual is unauthorized and does not further approach the sensor, the image data may not necessarily be acquired and/or sent to the user. This may, for example, save power and expense. In other implementations, image capture is triggered based on the sensed distance, such as by energizing an image capture circuit in response to the individual moving within a certain threshold of the sensor. In still other implementations involve a warning such as the audible warning above, in connection with a delayed image capture that is also based on the individual moving within a threshold distance from the sensor that is closer than a distance at which the warning is provided.

Turning now to the figures, FIG. 1 shows an apparatus 100 for providing security, in accordance with an example embodiment. The apparatus 100 includes a security device 102, including a presence sensor 110, an image sensor 120, and an authorization circuit 130 that operate to detect and identify the individual 104 as authorized or not authorized. The apparatus 100 also includes an electromechanical device 140 that physically deploys (e.g., sprays) a tangible deterrent in the vicinity of the individual 104 when that individual 104 is determined to be unauthorized. The apparatus 100 also includes a power source 150 and memory that stores image-based user data 132.

In one embodiment, the presence sensor 110 monitors an area and, in response to sensing the presence of the individual 104, provides a signal to the image sensor 120 which responds by capturing an image of the individual 104. The captured image is presented as image data 160 to the authorization circuit 130, which accesses the image-based user data 132 for authorizing the individual 104. If the individual 104 is identified as unauthorized (or simply as not authorized), the authorization circuit 130 generates an output that is used, either directly as shown or indirectly, to dispense a deterrent from the electromechanical device 140.

The dashed line of the security device 102 denotes an embodiment in which the components as shown are integrated together, such as in a common security unit. However, the various components as shown may be implemented separately or with two more of the components implemented together but separate from the rest. For example, components 110, 120, 130 and 132 may be integrated on a common chip, and within a housing that includes the electromechanical device 140 and power source 150.

In another example, the presence sensor 110 and image sensor 120 are integrated in a common device, and the authorization circuit 130 is remote from the presence sensor 110 and image sensor 120. The apparatus 100 also includes a wireless communication circuit 160 that wirelessly communicates the image data between the image sensor 120 and the user authorization circuit 130. In another embodiment, the apparatus 100 also includes a wireless communication circuit 170, which wirelessly communicates an alarm signal to a control panel in response to the individual 104 being identified as unauthorized. Such an approach may, for example, involve the use of a wireless sensor that also operates to dispense a deterrent, or in which the control panel controls the dispensing of a deterrent from a different but nearby device.

Figure 2:
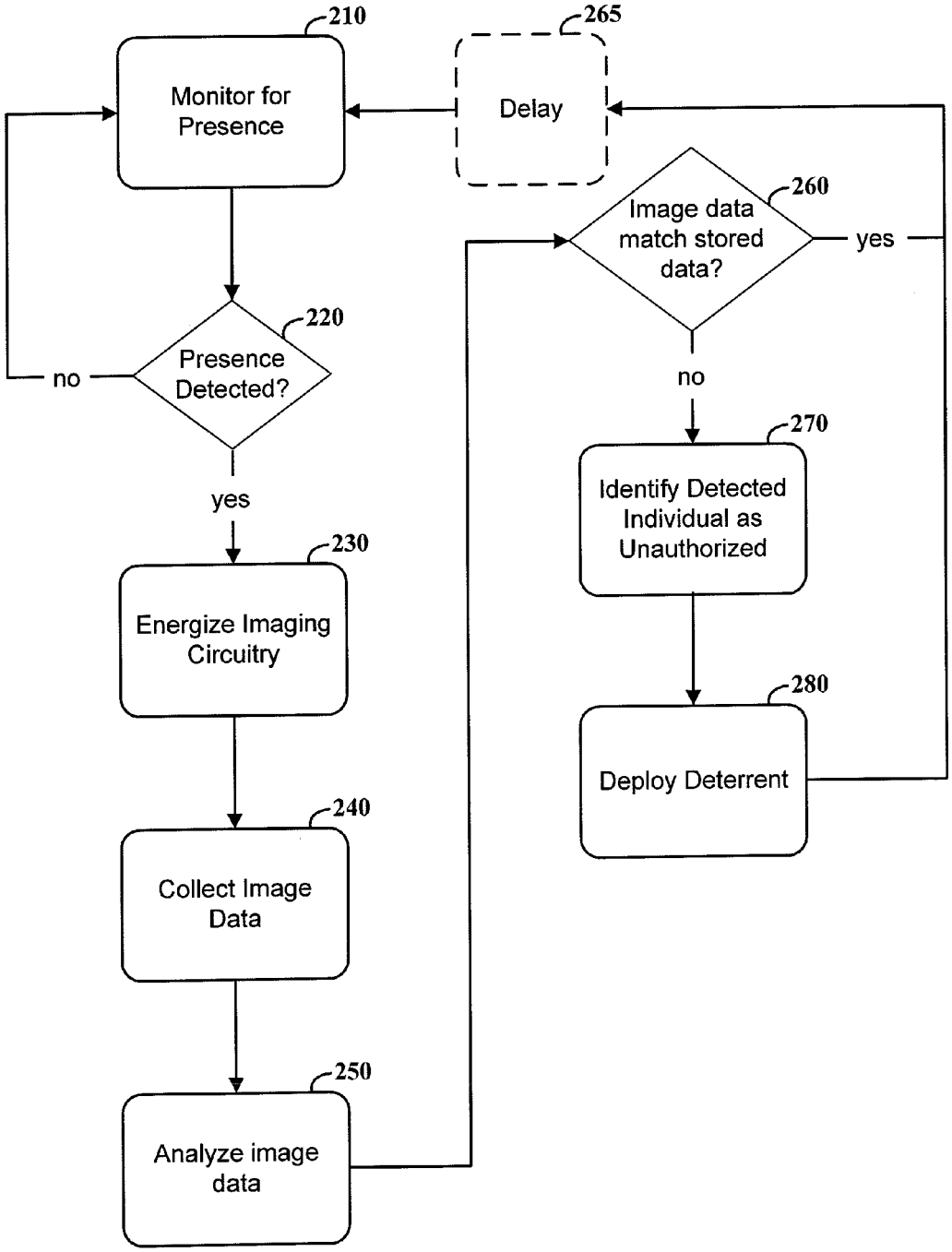
FIG. 2 shows a flow diagram for a method of providing security, in accordance with another example embodiment.

FIG. 2 shows a flow diagram for a method of providing security, in accordance with another example embodiment. At block 210, monitoring for the presence of an individual is carried out, such as by using a motion sensor in an entryway or other premises location. If presence is not detected at block 220, the process continues at block 210. When the presence of an individual is detected at block 220, imaging circuitry is energized at block 230, and image data is collected at block 240. Such an approach may include, for example, using a photosensor, charge-coupled device (CCD) or other component and circuitry to generate a signal corresponding to incident light.

Collected image data is analyzed at block 250. If the individual is identified as authorized, the process continues at block 210. In some implementations, a delay is carried out at block 265, such as to allow time for an authorized user to move out of a protected area and not require reimaging. In other implementations, individuals identified as authorized are tracked at block 265, and a delay is carried out with respect to presence sensing until after the user leaves the scene. In still other implementations, the presence sensing and imaging is carried out while an authorized individual is still present, to detect the presence of an unauthorized individual that is also in the same area. Such an approach may, for example, be useful for detecting an unauthorized individual sneaking up behind an authorized individual attempting to enter a building.

If the image data is does not match stored image data at block 260, the detected individual is identified as being unauthorized at block 270, and a deterrent is deployed at block 280 as discussed herein. The process can then continue at block 210, with an optional delay at block 265 as described above.

In a more particular implementation, the imaging circuitry is energized at block 230 so long as the presence of one or more individuals is detected. The image data is collected at block 240 and analyzed at block 250 to identify the presence of different individuals, and independently ascertain whether each individual is authorized or unauthorized. In certain implementations in which different individuals are identified as authorized and unauthorized in a common vicinity, the relative position of each individual is tracked and the deterrent is deployed at block 280 toward the unauthorized individual. Such an approach may, for example, be coupled with warnings presented to one or both individuals, prior to the deterrent being deployed. In certain implementations under such conditions, the authorized user may disable the deployment of the deterrent, such as by presenting a password (e.g., verbally) or key that is recognized and processed to disable deterrent deployment. Such an approach may, for example, be carried out in the apparatus 100, such as with the authorization circuit 130 operating to identify and track different individuals, and control the electromechanical device 140 for dispensing the deterrent accordingly. In certain such embodiments involving the apparatus 100, the electromechanical device includes one or more motors or other motion controllers that operate to direct a nozzle or other deployment device to dispense the deterrent at the tracked location of the unauthorized individual.

Various blocks, modules or other circuits may be implemented to carry out one or more of the operations and activities described herein and/or shown in the figures. In these contexts, a "block" (also sometimes "logic circuitry" or "module") is a circuit that carries out one or more of these or related operations/activities (e.g., sensing motion, sensing distance, or controlling the dispensing of a deterrent). For example, in certain of the above-discussed embodiments, one or more modules are discrete logic circuits or programmable logic circuits configured and arranged for implementing these operations/activities, as in the circuit modules shown in FIG. 1. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by a computer (or other electronic device) to perform these operations/activities.

Various embodiments described above may be implemented together and/or in other manners. One or more of the items depicted in the present disclosure can also be implemented separately or in a more integrated manner, or removed and/or rendered as inoperable in certain cases, as is useful in accordance with particular applications. In view of the description herein, those skilled in the art will recognize that many changes may be made thereto without departing from the spirit and scope of the present disclosure.

What is claimed is:

1. An apparatus comprising:

a presence sensor configured and arranged to sense the presence of an individual and a distance between the individual and the presence sensor;

an image sensor configured and arranged to capture an image of the individual in response to the presence sensor sensing the presence of the individual, and to provide the captured image as image data;

a user authorization circuit configured and arranged to identify the individual as being authorized or unauthorized based upon the provided image data and stored image data for authorized individuals;

a warning circuit configured and arranged with the presence sensor to generate audible sound by generating a warning to the individual in response to: the user authorization circuit identifying the individual as being unauthorized, and the sensed distance decreasing to a first threshold; and an electromechanical device configured and arranged with the user authorization circuit to deploy at least one tangible deterrent in the vicinity of the individual, in response to the user authorization circuit identifying the individual as being unauthorized and the sensed distance decreasing to a second threshold that is a shorter distance than the first threshold.

2. The apparatus of claim 1, wherein the user authorization circuit is configured and arranged to transmit the image data over a network in response to identifying the individual as being unauthorized;

further including a remote interface configured and arranged to use the transmitted image data to display an image of the individual identified as being unauthorized for verification by a user, and to transmit a deterrent deployment instruction over the network in response to a user input received from the user; and wherein the electromechanical device is configured and arranged with the remote interface to deploy the at least one deterrent in the vicinity of the individual in response to the deterrent deployment instruction.

3. The apparatus of claim 2, wherein the presence sensor is configured and arranged to sense the distance between the individual and the presence sensor as the individual is moving relative to the presence sensor, wherein the warning circuit is an audio circuit and the warning is an audible sound warning in the vicinity of the individual, and wherein the user authorization circuit is configured and arranged to transmit the image data in response to the sensed distance decreasing to a second threshold that is a shorter distance than the first threshold.

4. The apparatus of claim 1, wherein the presence sensor is configured and arranged to sense the distance between the individual and the presence sensor as the individual is moving relative to the presence sensor, and the image sensor is configured and arranged to transmit the image in response to the sensed distance decreasing to a threshold.

5. The apparatus of claim 1, wherein the presence sensor is configured and arranged to sense the distance between the individual and the presence sensor as the individual is moving relative to the presence sensor, and the image sensor is configured and arranged to transmit the image in response to the sensed distance decreasing to a second threshold that is a shorter distance than the first threshold.

6. The apparatus of claim 1, wherein the presence sensor is configured and arranged to sense the distance between the individual and the presence sensor as the individual is moving relative to the presence sensor, and the image sensor is configured and arranged with the presence sensor to transmit the image of the individual in response to the distance between the individual and the presence sensor decreasing to a threshold distance level.

7. The apparatus of claim 1, wherein the presence sensor is configured and arranged to sense the distance between the individual and the presence sensor as the individual is moving relative to the presence sensor, and wherein the warning circuit is an audio circuit and the warning is an audible sound warning in the vicinity of the individual.

8. The apparatus of claim 7, wherein the audible sound warning includes sound informing the individual that a toxic substance will be deployed if the individual moves further toward the presence sensor, and the at least one deterrent does not include the toxic substance.

9. The apparatus of claim 7, further including a light-emitting circuit configured and arranged with the presence sensor to flash a light at a rate that increases in response to the distance between the individual and the presence sensor decreasing.

10. The apparatus of claim 1, wherein the user authorization circuit is configured and arranged with the image sensor to process the image data based on facial recognition criteria, using stored facial recognition criteria indicative of authorized individuals, and therefrom identify the individual as an authorized individual or an unauthorized individual.

11. The apparatus of claim 1, wherein the user authorization circuit is configured and arranged to identify the individual as being unauthorized in response to the provided image data not matching the stored image data.

12. The apparatus of claim 1, wherein the presence sensor and image sensor are integrated in a common device, and the user authorization circuit is remote from the presence sensor and image sensor, further including a wireless communication circuit configured and arranged to wirelessly communicate the image data between the image sensor and the user authorization circuit.

13. The apparatus of claim 1, wherein the user authorization circuit is configured and arranged with the image sensor to identify different individuals from which images are concurrently captured as authorized or unauthorized, to track the location of the different individuals, and in response to one of the individuals being identified as unauthorized, operate the electromechanical device to direct the deterrent at the tracked location of the one of the individuals identified as unauthorized.

14. The apparatus of claim 13, further including a wireless communication circuit configured and arranged to wirelessly communicate an alarm signal to a control panel in response to the individual being identified as unauthorized.

15. The apparatus of claim 1, wherein the electromechanical device is configured and arranged to deploy the at least one deterrent by deploying a liquid spray.

16. A method comprising:

sensing the presence of an individual;

capturing an image of the individual in response to sensing the presence of the individual;

providing the captured image as image data;

sensing a distance between the individual and a presence sensor that senses the presence of the individual;

in a user authorization circuit that receives the image data, identifying the individual as being authorized based upon the provided image data and stored image data for authorized individuals;

generating an audible sound warning in the vicinity of the individual in response to: the user authorization circuit identifying the individual as being unauthorized, and the sensed distance decreasing to a first threshold;

transmitting the image data over a network in response to identifying the individual as being unauthorized; and automatically deploying at least one tangible deterrent via an electromechanical device in the vicinity of the individual, in response to the user authorization circuit identifying the individual as being unauthorized and a deterrent deployment instruction received over the network.

17. The method of claim 16, further including displaying an image of the individual identified as being unauthorized for verification by a user, and transmitting the deterrent deployment instruction over the network in response to a user input received from the user.

18. The method of claim 16, wherein capturing the image includes, in response to the sensed distance decreasing to a threshold, energizing an image capture circuit and using the image capture circuit to capture the image.

19. The method of claim 16, wherein capturing the image includes capturing the image in response to the sensed distance decreasing to a second threshold that is a shorter distance than the first threshold.

* * * * *